US012729474B2

(12) United States Patent
Dunn et al.

(10) Patent No.: US 12,729,474 B2
(45) Date of Patent: Sep. 8, 2026

(54) LAUNDRY TREATMENT APPLIANCE AND METHOD OF OPERATING THE SAME IN A VACATION MODE

(71) Applicant: Haier US Appliance Solutions, Inc., Wilmington, DE (US)

(72) Inventors: David Scott Dunn, Louisville, KY (US); Jivko Ognianov Djerekarov, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 72 days.

(21) Appl. No.: 18/612,269

(22) Filed: Mar. 21, 2024

(65) Prior Publication Data

US 2025/0297418 A1 Sep. 25, 2025

(51) Int. Cl.

| | |
|---|---|
| ***D06F 33/52*** | (2020.01) |
| ***D06F 34/06*** | (2020.01) |
| ***D06F 34/26*** | (2020.01) |
| ***D06F 101/20*** | (2020.01) |
| ***D06F 103/38*** | (2020.01) |
| ***D06F 105/26*** | (2020.01) |

(52) U.S. Cl.

CPC ..... *D06F 33/52* (2020.02); *D06F 34/06* (2020.02); *D06F 34/26* (2020.02); *D06F 2101/20* (2020.02); *D06F 2103/38* (2020.02); *D06F 2105/26* (2020.02)

(58) Field of Classification Search

CPC ..... D06F 25/00; D06F 33/69; D06F 2105/26

See application file for complete search history.

(56) References Cited

U.S. PATENT DOCUMENTS

| | | | | |
|---|---|---|---|---|
| 2,611,256 | A * | 9/1952 | Candor | D06F 39/08 68/12.14 |
| 8,739,577 | B2 | 6/2014 | Kwak et al. | |
| 2012/0284930 | A1 | 11/2012 | Robertson et al. | |
| 2016/0244904 | A1 | 8/2016 | Broitzman | |
| 2016/0377673 | A1* | 12/2016 | Cecco | A47L 15/0049 324/511 |
| 2021/0140086 | A1* | 5/2021 | Salvi | D06F 17/12 |
| 2022/0325463 | A1* | 10/2022 | Kim | D06F 58/206 |
| 2023/0059400 | A1 | 2/2023 | Damtew et al. | |
| 2023/0089461 | A1 | 3/2023 | Byoun et al. | |

FOREIGN PATENT DOCUMENTS

| | | |
|---|---|---|
| CN | 113512858 A | 10/2021 |

* cited by examiner

*Primary Examiner* — Spencer E. Bell
(74) *Attorney, Agent, or Firm* — Dority & Manning, P.A.

(57) ABSTRACT

A laundry treatment appliance includes a cabinet; a door movably coupled to the cabinet between an open position and a closed position; a tub provided within the cabinet; a heating system in fluid communication with the tub, the heating system comprising a heating element and a fan; and a controller operably coupled with the heating assembly, the controller configured to perform an operation. The operation includes receiving an input signal to enter a predetermined operational mode; adjusting the door to a locked state; activating the heating element at a predetermined power level; directing the fan according to a predetermined speed for a predetermined length of time; and deactivating the heating element after an expiration of the predetermined length of time.

9 Claims, 4 Drawing Sheets

LAUNDRY TREATMENT APPLIANCE AND METHOD OF OPERATING THE SAME IN A VACATION MODE

FIELD OF THE INVENTION

The present subject matter relates generally to laundry treatment appliances, and more particularly to methods of operating laundry treatment appliances to reduce undesirable odors and improve freshness.

BACKGROUND OF THE INVENTION

Laundry treatment appliances are generally configured to perform a washing operation of washing articles, a drying operation of washing articles, or each of the washing operation and drying operation. Such laundry treatment appliances may include a tub, a drum rotatably provided in the tub, a sump to collect water from the tub, and an air circulation system (e.g., in a combination washer/dryer appliance). Water supplied to the tub for the washing operation may be collected within the sump. to either be drained from the appliance or recirculated throughout the tub. The air circulation system may include a heat source and a fan for providing heated air to the tub during the drying operation.

Some appliances may experience periods of stagnation or lack of use, such as in vacation homes or while users are on a vacation themselves. During such periods of non-use, water may collect within the sump. For instance, the drain may not completely drain all of the water from a previous washing load. Thus, the stagnant water may be retained within the sump for extended periods of time. Existing appliances are insufficient at preventing potential damage or negative effects produced by stagnant water within the sump.

Accordingly, a laundry treatment appliance which obviates one or more of the above-mentioned drawbacks would be beneficial. In particular, a laundry treatment appliance with a vacation mode to reduce or eliminate harmful effects of stagnant water within a sump of the appliance would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry treatment appliance is provided. The laundry treatment appliance may include a cabinet defining an inlet opening; a door movably coupled to the cabinet between an open position and a closed position, the door being lockable in the closed position; a tub provided within the cabinet; a heating system in fluid communication with the tub, the heating system including a heating element and a fan; and a controller operably coupled with the heating assembly, the controller configured to perform an operation. The operation may include receiving an input signal to enter a predetermined operational mode; adjusting the door to a locked state in response to receiving the input signal to enter the predetermined operational mode; activating the heating element at a predetermined power level after adjusting the door to the locked state; directing the fan according to a predetermined speed for a predetermined length of time after activating the heating element; and deactivating the heating element after an expiration of the predetermined length of time.

In another exemplary aspect of the present disclosure, a method of operating a laundry treatment appliance is provided. The laundry treatment appliance may include a door, a tub, a heating element, and a fan. The method may include receiving an input signal to enter a predetermined operational mode; adjusting the door to a locked state in response to receiving the input signal to enter the predetermined operational mode; activating the heating element at a predetermined power level after adjusting the door to the locked state; directing the fan according to a predetermined speed for a predetermined length of time after activating the heating element; and deactivating the heating element after an expiration of the predetermined length of time.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
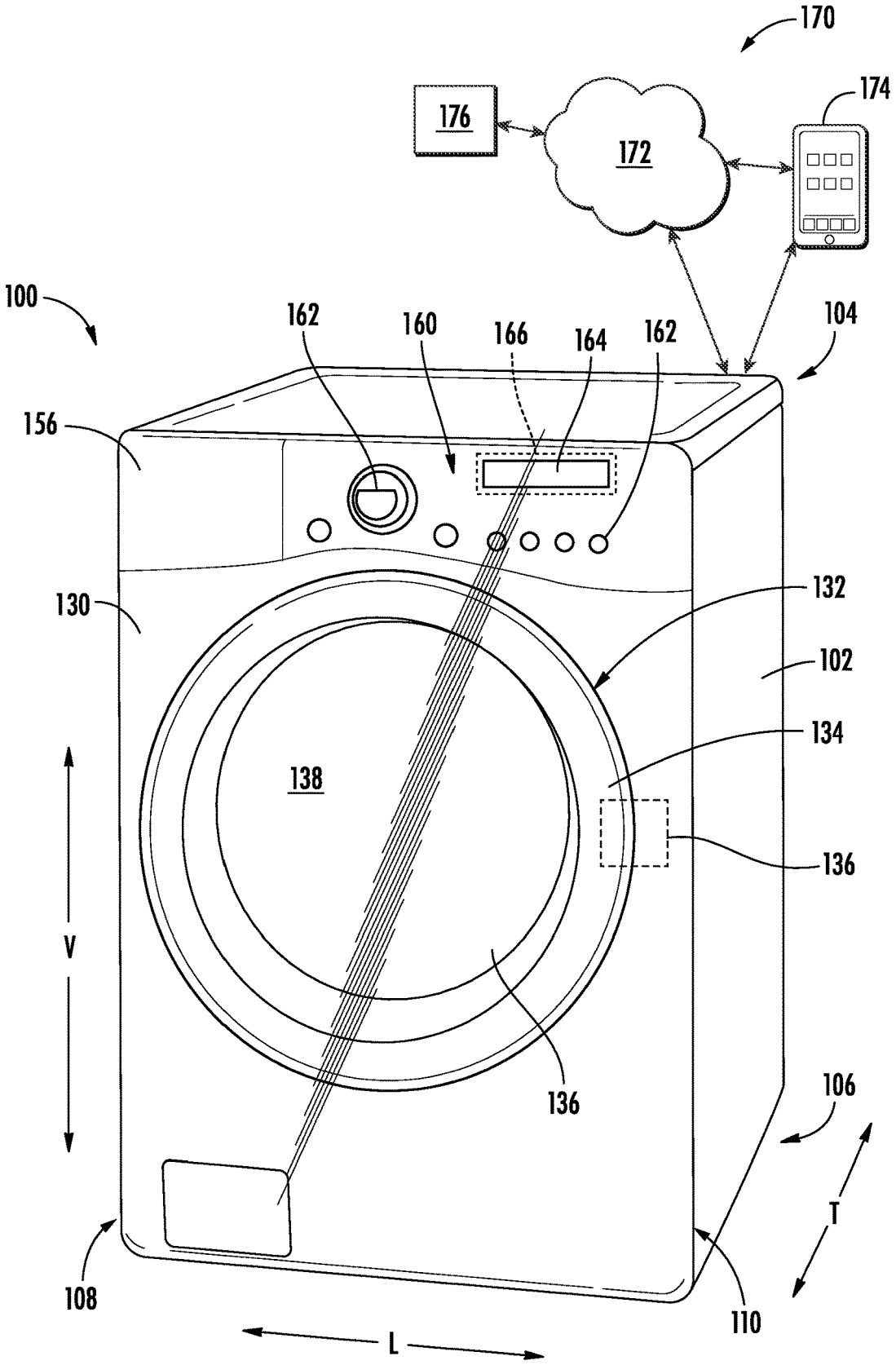
FIG. 1 provides a perspective view of a laundry appliance in accordance with exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
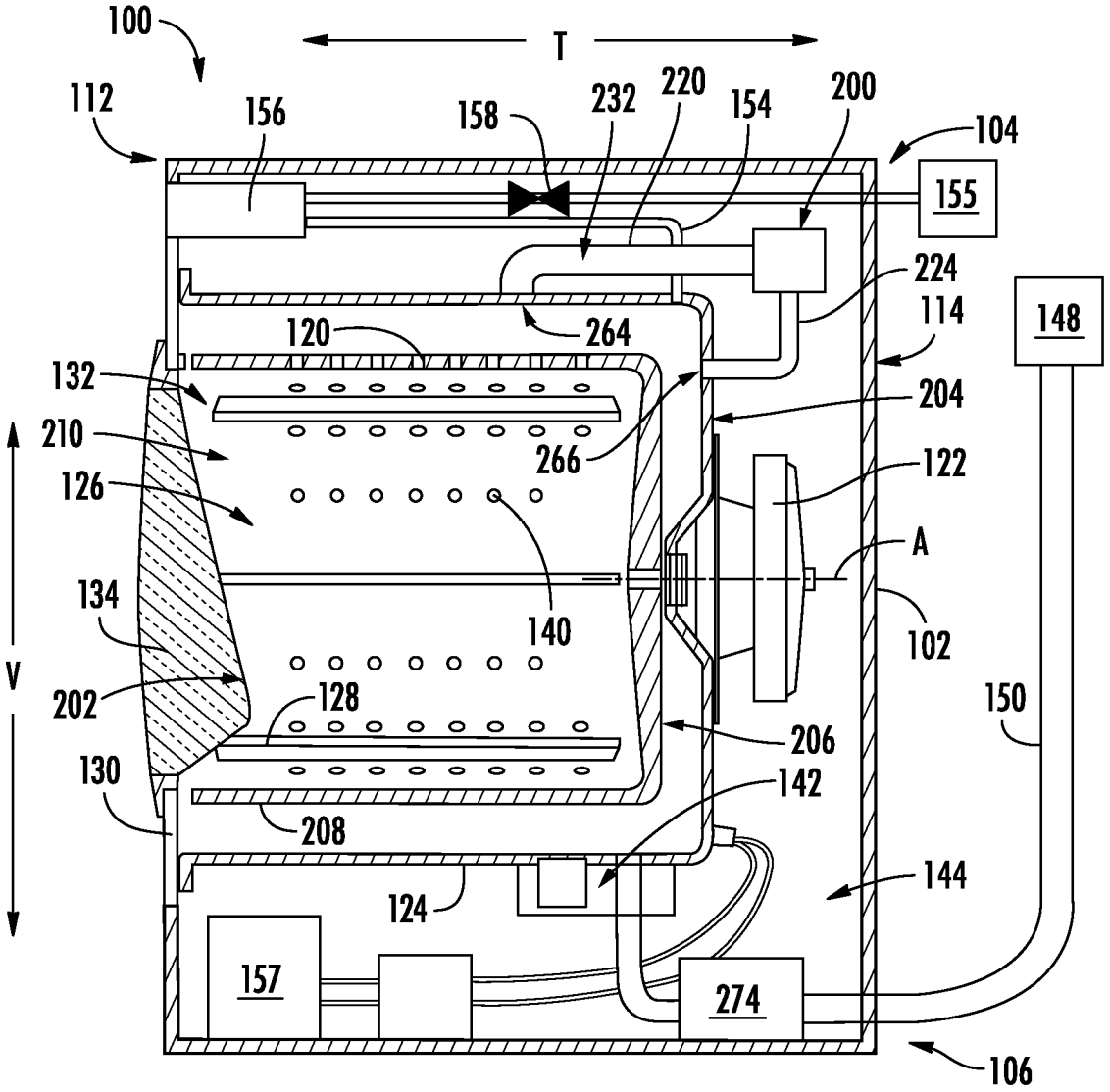
FIG. 2 provides a side sectional view of the exemplary laundry appliance of FIG. 1.

Referring now to the figures, an exemplary laundry appliance that may be used to implement aspects of the present subject matter will be described. Specifically, FIG. 1 is a perspective view of an exemplary horizontal axis washer/dryer appliance 100 (e.g., washer and condenser dryer combination appliance), referred to herein for simplicity as laundry treatment appliance or laundry appliance 100. FIG. 2 is a side sectional view of laundry appliance 100. As illustrated, laundry appliance 100 generally defines a vertical direction V, a lateral direction L, and a transverse direction T, each of which is mutually perpendicular, such that an orthogonal coordinate system is generally defined. Laundry appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a laundry basket 120 is rotatably mounted within cabinet 102 such that it is rotatable about an axis of rotation A. According to the illustrated embodiment, axis of rotation A is substantially parallel to a horizontal direction (e.g., the transverse direction T), as this exemplary appliance is a front load appliance. A motor 122, such as a pancake motor, is in mechanical communication with laundry basket 120 to selectively rotate laundry basket 120 (e.g., during an agitation or a rinse phase of laundry appliance 100). Motor 122 may be mechanically coupled to laundry basket 120 directly or indirectly (e.g., via a pulley and a belt—not pictured). Laundry basket 120 is received within a tub 124 that defines a chamber 126 that is configured for receipt of articles for washing or drying.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together or dried together in laundry appliance 100 (e.g., the combination washer and condenser dryer) and may include a mixture of different or similar articles of clothing of different or similar types and kinds of fabrics, textiles, garments and linens within a particular laundering process.

The tub 124 holds wash and rinse fluids for agitation in laundry basket 120 within tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Laundry basket 120 may define one or more agitator features that extend into chamber 126 to assist in agitation, cleaning, and drying of articles disposed within chamber 126 during operation of laundry appliance 100. For example, as illustrated in FIG. 2, a plurality of baffles or ribs 128 extend from basket 120 into chamber 126. In this manner, for example, ribs 128 may lift articles disposed in laundry basket 120 and then allow such articles to tumble back to a bottom of drum laundry basket 120 as it rotates. Ribs 128 may be mounted to laundry basket 120 such that ribs 128 rotate with laundry basket 120 during operation of laundry appliance 100.

Referring generally to FIGS. 1 and 2, cabinet 102 may include a front panel 130 which defines an opening 132 that permits user access to laundry basket 120 and tub 124. More specifically, laundry appliance 100 includes a door 134 that is positioned over opening 132 and is rotatably mounted to front panel 130. In this manner, door 134 permits selective access to opening 132 by being movable between an open position (not shown) facilitating access to a tub 124 and a closed position (FIG. 1) prohibiting access to tub 124. Laundry appliance 100 may further a latch assembly 136 (see FIG. 1) that is mounted to cabinet 102 or door 134 for selectively locking door 134 in the closed position or detecting the door 134 in the closed position. Latch assembly 136 may be desirable, for example, to ensure only secured access to chamber 126 or to otherwise ensure and verify that door 134 is closed during certain operating cycles or events.

In some embodiments, a window 138 in door 134 permits viewing of laundry basket 120 when door 134 is in the closed position (e.g., during operation of laundry appliance 100). Door 134 may include a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, laundry basket 120 may also define a plurality of perforations 140 in order to facilitate fluid communication between an interior of basket 120 and tub 124. A sump 142 is defined by tub 124 at a bottom of tub 124 along the vertical direction V. Thus, sump 142 is configured for receipt of and generally collects wash fluid during operation of laundry appliance 100. For example, during operation of laundry appliance 100, wash fluid may be urged by gravity from basket 120 to sump 142 through plurality of perforations 140.

In some embodiments, a drain pump assembly 144 is located beneath tub 124 and is in fluid communication with sump 142 for periodically discharging soiled wash fluid from laundry appliance 100. Drain pump assembly 144 may generally include a drain pump 274 which is in fluid communication with sump 142 and with an external drain 148 through a drain hose 150. During a drain cycle or phase (e.g., as a portion of a wash cycle), drain pump 274 urges a flow of wash fluid from sump 142, through drain hose 150, and to external drain 148. More specifically, drain pump 274 includes a motor (not shown) which is energized during a drain cycle such that drain pump 274 draws wash fluid from sump 142 and urges it through drain hose 150 to external drain 148.

A spout 154 is configured for directing a flow of fluid into tub 124. For example, spout 154 may be in fluid communication with a water supply 155 (FIG. 2) in order to direct fluid (e.g., clean water or wash fluid) into tub 124. Spout 154 may also be in fluid communication with the sump 142. For example, pump assembly 144 may direct wash fluid disposed in sump 142 to spout 154 in order to circulate wash fluid in tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash chamber 126 during operation of laundry appliance 100. According to the illustrated embodiment, detergent drawer 156 may also be fluidly coupled to spout 154 to facilitate the complete and accurate dispensing of wash additive.

In optional embodiments, a bulk reservoir 157 is disposed within cabinet 102 and is configured for receipt of fluid additive or detergent for use during operation of laundry appliance 100. Moreover, bulk reservoir 157 may be sized such that a volume of fluid additive sufficient for a plurality or multitude of wash cycles of laundry appliance 100 (e.g., five, ten, twenty, fifty, or any other suitable number of wash cycles) may fill bulk reservoir 157. Thus, for example, a user can fill bulk reservoir 157 with fluid additive and operate laundry appliance 100 for a plurality of wash cycles without refilling bulk reservoir 157 with fluid additive. A reservoir pump (not shown) may be configured for selective delivery of the fluid additive from bulk reservoir 157 to tub 124.

A water supply valve or control valve 158 may provide a flow of water from a water supply source (such as a municipal water supply 155) into detergent dispenser 156 or into tub 124. In this manner, control valve 158 may generally be operable to supply water into detergent dispenser 156 to generate a wash fluid (e.g., for use in a wash cycle) or a flow of fresh water (e.g., for a rinse phase). It should be appreciated that control valve 158 may be positioned at any other suitable location within cabinet 102.

A control panel 160 including a plurality of input selectors 162 (e.g., buttons, knobs, toggles, touch screens, etc.) is coupled to front panel 130. Control panel 160 and input selectors 162 collectively form a user interface input for operator selection of machine cycles and features. For example, in one embodiment, a display 164 indicates selected features, a countdown timer, or other items of interest to machine users.

Operation of laundry appliance 100 is controlled by a controller or processing device 166 (FIG. 1) that is operatively coupled to control panel 160 for user manipulation to select laundry cycles and features. In response to user manipulation of control panel 160, controller 166 operates the various components of laundry appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry-such as switches, amplifiers, integrators, comparators, flip-flops, AND gates, and the like) to perform control functionality instead of relying upon software. Control panel 160 and other components of laundry appliance 100 may be in communication with controller 166 via one or more signal lines or shared communication busses.

During operation of laundry appliance 100, laundry items are loaded into laundry basket 120 through opening 132, and a washing or wash/dry operation (e.g., having discrete wash and dry cycles) is initiated through operator manipulation of input selectors 162. Tub 124 is filled with water, detergent, or other fluid additives (e.g., via spout 154 and or detergent drawer 156). One or more valves (e.g., control valve 158) can be controlled by laundry appliance 100 to provide for filling laundry basket 120 to the appropriate level for the amount of articles being washed or rinsed. By way of example for a wash cycle, once laundry basket 120 is properly filled with fluid, the contents of laundry basket 120 can be agitated (e.g., with ribs 128) for washing of articles in laundry basket 120.

After an agitation phase of the wash cycle is completed, tub 124 can be drained. Laundry articles can then be rinsed by again adding fluid to tub 124, depending on the particulars of the cleaning cycle selected by a user. Ribs 128 may again provide agitation within laundry basket 120. One or more spin cycles or phases may also be used. In particular, a spin phase may be applied after the wash cycle or after the rinse phase in order to wring wash fluid from the articles being washed. During a final spin cycle, basket 120 is rotated at relatively high speeds and drain pump assembly 144 may discharge wash fluid from sump 142. Following the wash cycle, a dry cycle may be executed or operation a user may selectively remove the articles from laundry basket 120 (e.g., by opening door 134 and reaching into laundry basket 120 through opening 132), as will be described in greater detail below.

While described in the context of a specific embodiment of horizontal axis laundry appliance 100, using the teachings disclosed herein it will be understood that horizontal axis laundry appliance 100 is provided by way of example only. Other laundry appliances having different configurations, different appearances, or different features may also be utilized with the present subject matter as well (e.g., vertical axis laundry appliances). Indeed, it should be appreciated that aspects of the present subject matter may further apply to other laundry appliances. In this regard, the same methods as systems and methods as described herein may be used to implement travel cycles for other appliances, as described in more detail below.

Referring still to FIG. 1, a schematic diagram of an external communication system 170 will be described according to an exemplary embodiment of the present subject matter. In general, external communication system 170 is configured for permitting interaction, data transfer, and other communications with laundry appliance 100. For example, this communication may be used to provide and receive operating parameters, user instructions or notifications, performance characteristics, user preferences, or any other suitable information for improved performance of laundry appliance 100.

External communication system 170 permits controller 166 of laundry appliance 100 to communicate with external devices either directly or through a network 172. For example, a consumer may use a consumer device 174 to communicate directly with laundry appliance 100. For example, consumer devices 174 may be in direct or indirect communication with laundry appliance 100, such directly through a local area network (LAN), Wi-Fi, Bluetooth, Zigbee, etc. or indirectly through network 172. In general, consumer device 174 may include its own user interface and be any suitable device for providing or receiving communications or commands from a user. In this regard, consumer device 174 may include, for example, a personal phone, a tablet, a laptop computer, or another mobile device.

In addition, a remote server 176 may be in communication with laundry appliance 100 or consumer device 174 through network 172. In this regard, for example, remote server 176 may be a cloud-based server 176, and is thus located at a distant location, such as in a separate state, country, etc. In general, communication between the remote server 176 and the client devices may be carried via a network interface using any type of wireless connection, using a variety of communication protocols (e.g. TCP/IP, HTTP, SMTP, FTP), encodings or formats (e.g. HTML, XML), or protection schemes (e.g. VPN, secure HTTP, SSL).

In general, network 172 can be any type of communication network. For example, network 172 can include one or more of a wireless network, a wired network, a personal area network, a local area network, a wide area network, the internet, a cellular network, etc. According to an exemplary embodiment, consumer device 174 may communicate with a remote server 176 over network 172, such as the internet, to provide user inputs, receive user notifications or instructions, etc. In addition, consumer device 174 and remote server 176 may communicate with laundry appliance 100 to communicate similar information.

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Figure 3:
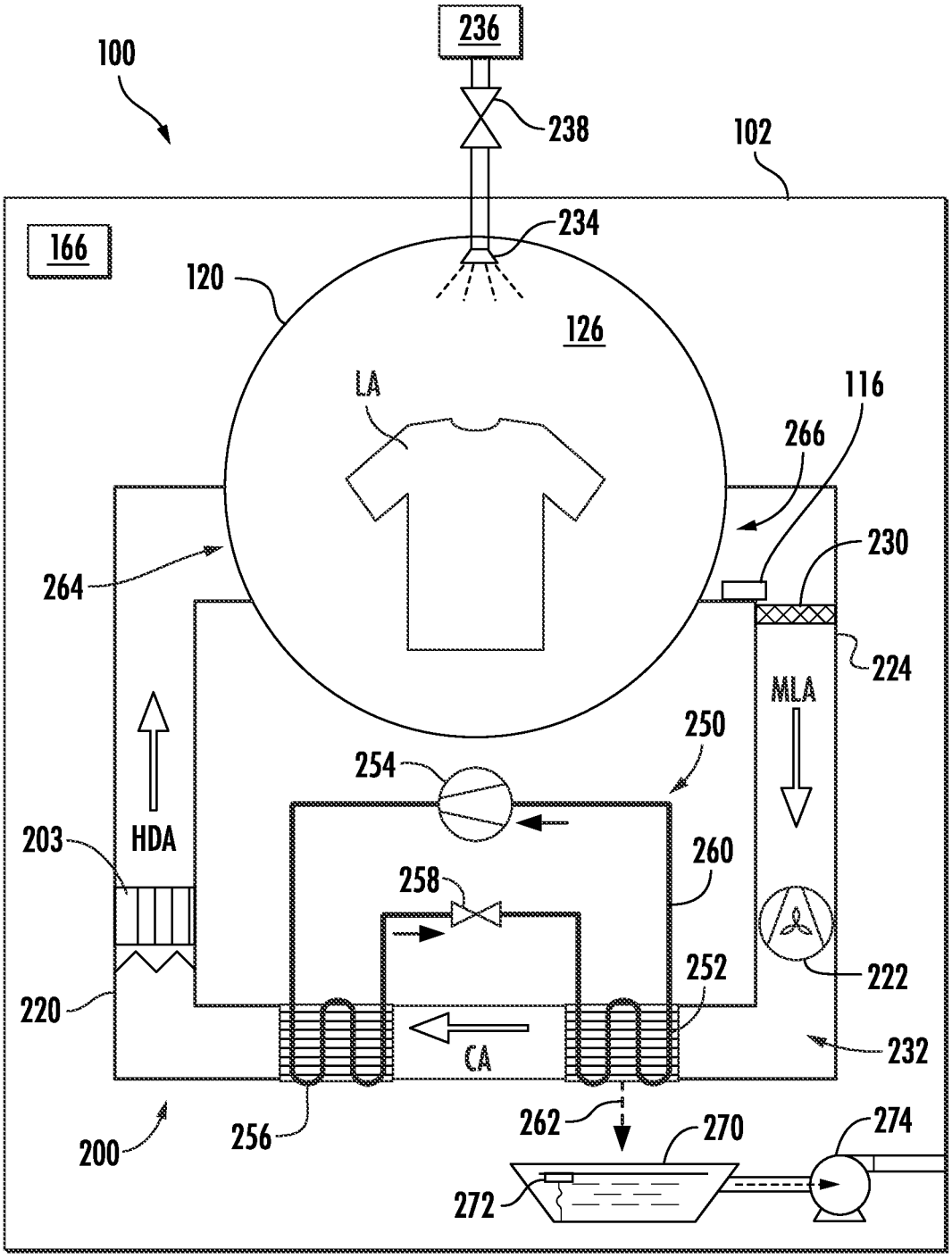
FIG. 3 provides a schematic diagram of an exemplary heat pump dryer appliance and a conditioning system thereof in accordance with exemplary embodiments of the present disclosure.
Figure 4:
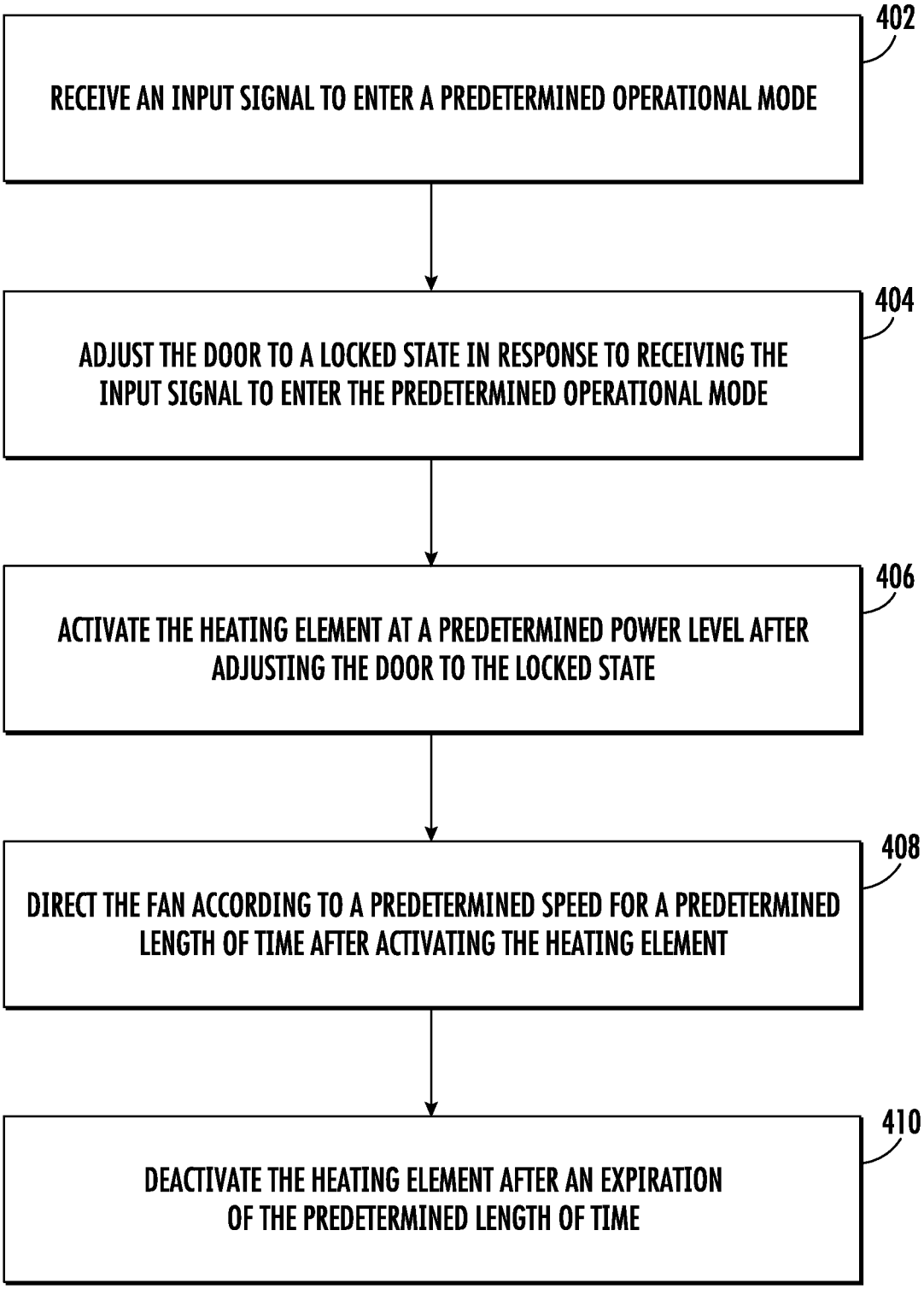
FIG. 4 illustrates a method for operating a laundry appliance in accordance with exemplary embodiments of the present disclosure.

Referring now specifically to FIGS. 2 and 3, a heater included with or provided as a heat pump system, a condenser system, a refrigerant-based air conditioning system, or another suitable conditioning system 200 for facilitating a drying process or dry cycle within laundry appliance 100 will be described in more detail. As illustrated, conditioning system 200 may be mounted to tub 124 such that it is fluidly coupled to chamber 126. More specifically, as illustrated, tub 124 extends between a front portion 202 and a back portion 204 (e.g., along the transverse direction T). Laundry basket 120 also includes a back or rear wall 206 (e.g., at back portion of laundry basket 120 or proximate back portion 204 of tub 124). Rear wall 206 of laundry basket 120 may be rotatably supported within cabinet 102 by a suitable bearing or may be fixed or rotatable.

In some embodiments, laundry basket 120 is generally cylindrical in shape. For instance, laundry basket 120 may have an outer cylindrical wall 208 and a front flange or wall that defines an opening 210 of laundry basket 120 (e.g., at front portion 202 of laundry basket 120). As shown, opening 210 generally coincides with opening 132 of front panel 112 of cabinet 102 (e.g., to provide user access to chamber 126 for loading and unloading of articles into and out of chamber 126 of laundry basket 120).

Conditioning system 200 may include a return duct 220 that is mounted to tub 124 for circulating air within chamber 126 to facilitate a dry cycle. For example, according to the illustrated exemplary embodiments, return duct 220 is fluid coupled to tub 124 proximate a top of tub 124. Return duct 220 receives heated air that has been heated or dehumidified by a conditioning system 200 and provides the heated air to laundry basket 120 via one or more holes defined by rear wall 206 or cylindrical wall 208 of laundry basket 120 (e.g., such as perforations 140).

Specifically, moisture laden, heated air is drawn from laundry basket 120 by an air handler, such as a blower fan 222, which may generate a negative air pressure within laundry basket 120. As the air passes from blower fan 222, it enters an intake duct 224 and then is passed into conditioning system 200. In some embodiments, the conditioning system 200 may have a heater that includes or is provided as an electric heating element (e.g., a resistive heating element 203) or a gas-powered heating element (e.g., a gas burner), as would be understood. According to the illustrated exemplary embodiment, laundry appliance 100 is a heat pump dryer appliance and thus conditioning system 200 may be or include a heater including a heat pump having a sealed refrigerant circuit, as described in more detail below with reference to FIG. 3. Heated air (with a lower moisture content than was received from laundry basket 120), exits conditioning system 200 and returns to laundry basket 120 by a return duct 220. After the clothing articles have been dried, they may be removed from the laundry basket 120 via opening 132.

As shown, laundry appliance 100 may further include one or more lint filters 230 (FIG. 3) to collect lint during drying operations. The moisture laden heated air passes through intake duct 224 enclosing screen filter 230, which traps lint particles. More specifically, filter 230 may be placed into an air flow path 232 defined by laundry basket 120, conditioning system 200, intake duct 224, and return duct 220. Filter 230 may be positioned in the process air flow path 232 and may include a screen, mesh, other material to capture lint in the air flow 232. The location of lint filters in laundry appliance 100 as shown in FIG. 3 is provided by way of example only, and other locations may be used as well. According to exemplary embodiments, lint filter 230 is readily accessible by a user of the appliance. As such, lint filter 230 should be manually cleaned by removal of the filter, pulling or wiping away accumulated lint, and then replacing the filter 230 for subsequent drying or dry cycles.

According to optional embodiments, laundry appliance 100 may facilitate a steam dry process. In this regard, laundry appliance 100 may offer a steam dry cycle, during which steam is injected into chamber 126 (e.g., to function similar to a traditional garment steamer to help remove wrinkles, static, etc.). Accordingly, as shown for example in FIG. 3, laundry appliance 100 may include a misting nozzle 234 that is in fluid communication with a water supply 236 (e.g., such as water supply 155) in order to direct mist into chamber 126. Laundry appliance 100 may further include a water supply valve or control valve 238 for selecting discharging the flow of mist into chamber 126. It should be appreciated that control valve 238 may be positioned at any other suitable location within cabinet 102.

FIG. 3 provides a schematic view of laundry appliance 100 and depicts conditioning system 200 in more detail. In the illustrated embodiments, laundry appliance 100 is a heat pump dryer appliance and thus conditioning system 200 includes a sealed system 250. Sealed system 250 includes various operational components, which can be encased or located within a machinery compartment of laundry appliance 100. Generally, the operational components are operable to execute a vapor compression cycle for heating process air passing through conditioning system 200. The operational components of sealed system 250 include an evaporator 252, a compressor 254, a condenser 256, and one or more expansion devices 258 connected in series along a refrigerant circuit or line 260. Refrigerant line 260 is charged with a working fluid, which in this example is a refrigerant. Sealed system 250 depicted in FIG. 3 is provided by way of example only. Thus, it is within the scope of the present subject matter for other configurations of the sealed system to be used as well. As will be understood by those skilled in the art, sealed system 250 may include additional components (e.g., at least one additional evaporator, compressor, expansion device, or condenser). For instance, sealed system 250 may include two evaporators.

In performing a dry cycle, one or more laundry articles LA may be placed within the chamber 126 of laundry basket 120. For instance, following a wash cycle, articles may remain within the chamber 126. Hot dry air HDA may be supplied to chamber 126 via return duct 220. The hot dry air HDA enters chamber 126 of laundry basket 120 via a tub inlet 264 defined by laundry basket 120 (e.g., the plurality of holes defined in rear wall 206 or cylindrical wall 208 of laundry basket 120 as shown in FIG. 2). The hot dry air HDA provided to chamber 126 causes moisture within laundry articles LA to evaporate. Accordingly, the air within chamber 126 increases in water content and exits chamber 126 as warm moisture laden air MLA. The warm moisture laden air MLA exits chamber 126 through a tub outlet 266 defined by laundry basket 120 and flows into intake duct 224.

After exiting chamber 126 of laundry basket 120, the warm moisture laden air MLA flows downstream to conditioning system 200. Blower fan 222 moves the warm moisture laden air MLA, as well as the air more generally, through a process air flow path 232 defined by laundry basket 120, conditioning system 200, intake duct 224, and return duct 220. Thus, generally, blower fan 222 is operable to move air through or along the process air flow path 232. The duct system includes all ducts that provide fluid communication (e.g., airflow communication) between tub outlet 266 and conditioning system 200 and between conditioning system 200 and tub inlet 264. Although blower fan 222 is shown positioned between laundry basket 120 and conditioning system 200 along intake duct 224, it will be appreciated that blower fan 222 can be positioned in other suitable positions or locations along the duct system.

As further depicted in FIG. 3, the warm moisture laden air MLA flows into or across evaporator 252 of the conditioning system 200. As the moisture-laden air MLA passes across evaporator 252, the temperature of the air is reduced through heat exchange with refrigerant that is vaporized within, for example, coils or tubing of evaporator 252. This vaporization process absorbs both the sensible and the latent heat from the moisture-laden air MLA-thereby reducing its temperature. As a result, moisture in the air is condensed and such condensate water may be drained from conditioning system 200 (e.g., using a drain line 262, which is also depicted in FIG. 3).

Laundry appliance 100 may include a temperature sensor 116 that is generally configured for detecting or monitoring a temperature of, e.g., air flowing through air flow path 232. Temperature sensor 116 may be positioned at or near filter 230. For instance, temperature sensor 116 may be configured to determine or monitor the temperature of air at or around filter 230. As used herein, "temperature sensor" or the equivalent is intended to refer to any suitable type of temperature measuring system or device positioned at any suitable location for measuring the desired temperature. Thus, for example, temperature sensor 116 may each be any suitable type of temperature sensor, such as a thermistor, a thermocouple, a resistance temperature detector, a semiconductor-based integrated circuit temperature sensors, etc. In addition, temperature sensor 116 may be positioned at any suitable location and may output a signal, such as a voltage, to a controller that is proportional to and/or indicative of the temperature being measured. Although exemplary positioning of temperature sensors is described herein, it should be appreciated that appliance 100 may include any other suitable number, type, and position of temperature, humidity, and/or other sensors according to alternative embodiments.

In optional embodiments, a condenser tank or a condensate collection tank 270 is in fluid communication with conditioning system 200 (e.g., via drain line 262). Collection tank 270 is operable to receive condensate water from the process air flowing through conditioning system 200, and more particularly, condensate water from evaporator 252. A sensor 272 operable to detect when water within collection tank 270 has reached a predetermined level. Sensor 272 can be any suitable type of sensor, such as a float switch as shown in FIG. 3. Sensor 272 can be communicatively coupled with controller 166 (e.g., via a suitable wired or wireless communication link). A drain pump 274 is in fluid communication with collection tank 270. Drain pump 274 is operable to remove a volume of water from collection tank 270 and, for example, discharge the collected condensate to an external drain. In some embodiments, drain pump 274 can remove a known or predetermined volume of water from collection tank 270. Drain pump 274 can remove the condensate water from collection tank 270 and can move or drain the condensate water downstream (e.g., to a gray water collection system). Particularly, in some embodiments, controller 166 is configured to receive, from sensor 272, an input indicating that water within the collection tank has reached the predetermined level. In response to the input indicating that water within collection tank 270 has reached the predetermined level, controller 166 can cause drain pump 274 to remove the predetermined volume of water from collection tank 270.

Air passing over evaporator 252 becomes cooler than when it exited laundry basket 120 at tub outlet 266. As shown in FIG. 3, cool air CA (cool relative to hot dry air HDA and moisture laden air MLA) flowing downstream of evaporator 252 is subsequently caused to flow across condenser 256 (e.g., across coils or tubing thereof), which condenses refrigerant therein. The refrigerant enters condenser 256 in a gaseous state at a relatively high temperature compared to the cool air CA from evaporator 252. As a result, heat energy is transferred to the cool air CA at the condenser 256, thereby elevating its temperature and providing warm dry air HDA for resupply to laundry basket 120 of laundry appliance 100. The warm dry air HDA passes over and around laundry articles LA within the chamber 126 of the laundry basket 120, such that warm moisture laden air MLA is generated, as mentioned above.

With respect to sealed system 250, compressor 254 pressurizes refrigerant (i.e., increases the pressure of the refrigerant) passing therethrough and generally motivates refrigerant through the sealed refrigerant circuit or refrigerant line 260 of conditioning system 200. Compressor 254 may be communicatively coupled with controller 166 (communication lines not shown in FIG. 3). Refrigerant is supplied from the evaporator 252 to compressor 254 in a low pressure gas phase. The pressurization of the refrigerant within compressor 254 increases the temperature of the refrigerant. The compressed refrigerant is fed from compressor 254 to condenser 256 through refrigerant line 260. As the relatively cool air CA from evaporator 252 flows across condenser 256, the refrigerant is cooled and its temperature is lowered as heat is transferred to the air for supply to chamber 126 of laundry basket 120.

Upon exiting condenser 256, the refrigerant is fed through refrigerant line 260 to expansion device 258. Although only one expansion device 258 is shown, such is by way of example only. It is understood that multiple such devices may be used. In the illustrated example, expansion device 258 is an electronic expansion valve, although a thermal expansion valve or any other suitable expansion device can be used. In additional embodiments, any other suitable expansion device, such as a capillary tube, may be used as well. Expansion device 258 lowers the pressure of the refrigerant and controls the amount of refrigerant that is allowed to enter the evaporator 252. Importantly, the flow of liquid refrigerant into evaporator 252 is limited by expansion device 258 in order to keep the pressure low and allow expansion of the refrigerant back into the gas phase in evaporator 252. The evaporation of the refrigerant in evaporator 252 converts the refrigerant from its liquid-dominated phase to a gas phase while cooling and drying the moisture laden air MLA received from chamber 126 of laundry basket 120. The process is repeated as air is circulated along process air flow path 232 while the refrigerant is cycled through sealed system 250, as described above.

In the case of a tumble cycle, the heater (e.g., sealed system 250) remains inactive such that heat is not actively generated or, alternatively, the heater may be directed to a relatively low heat setting (i.e., a first heat setting that is lower in power, voltage, duty cycle, or temperature than a second heat setting of the dry cycle). For instance, the compressor 254 may be directed to a reduced state. Optionally, compressor 254 may be held inactive to restrict the flow of refrigerant through sealed system 250. Nonetheless, air may be cycled through chamber 126 along the same path as air circulated during a dry cycle (e.g., as described above).

Although laundry appliance 100 is depicted and described herein as a heat pump dryer appliance, the inventive aspects of the present disclosure can apply to other types of closed loop airflow circuit dryer appliances. For instance, in other embodiments, laundry appliance 100 can utilizes an air-to-air heat exchanger instead of evaporator 252 or an electric or gas heating element may be provided instead of condenser 256. Thus, in such embodiments, the working fluid that interacts thermally with the process air may be air. Further, in some embodiments, laundry appliance 100 can be a combination washer/dryer appliance having a closed loop airflow circuit along which process air may flow for drying operations.

Now that the construction of laundry appliance 100 and the configuration of controller 166 according to exemplary embodiments have been presented, an exemplary method 400 of operating a laundry appliance will be described. Although the discussion below refers to the exemplary method 400 of operating laundry appliance 100, one skilled in the art will appreciate that the exemplary method 400 is applicable to the operation of a variety of other laundry appliances. In exemplary embodiments, the various method steps as disclosed herein may be performed by controller 166 (e.g., as a wash/dry operation) or a separate, dedicated controller.

Advantageously, embodiments described herein may automatically (e.g., without requiring direct user input) preserve articles within a given load to prevent the development of wrinkles, mildew, foul smells, etc. Additionally or alternatively, the described embodiments may notably permit a user to selectively adjust operation (e.g., a wash/dry operation) of a laundry appliance to ensure certain articles are properly treated or evaluated.

At step 402, method 400 may include receiving an input signal to enter a predetermined operational mode. In detail, the appliance (e.g., laundry appliance 100) may be a combination washer/dryer appliance capable of performing each of a washing operation and a drying operation. As mentioned, the appliance may include a user interface including one or more input selectors. According to some embodiments, the input signal may be received directly from the user interface. For instance, a user may input a manual input signal such as a predetermined sequence or code to initiate the predetermined operational mode. In additional or alternative embodiments, the input signal may include a remote signal. For instance, the input signal may be delivered from a remote connected device, such as a mobile phone or other connected smart device.

In still further embodiments, the signal may be automatically received based on an activity pattern of the appliance. In detail, method 400 may determine that the appliance has been nonoperational for a predetermined idle time length. The activity or usage pattern may thus be based on interaction between the appliance and one or more users. Thus, when the appliance is inoperative, idle, or otherwise not used for the predetermined idle time length, the predetermined operational mode may be initiated. According to some embodiments, the predetermined idle time length may be between about 2 days and about 14 days. For example, the appliance may automatically initiate or enter the predetermined operational mode after the appliance is inactive for between at least 2 days and at least 14 days. However, it should be understood that the ranges presented herein are provided by way of example only and that any suitable idle time length may be incorporated in specific embodiments.

The predetermined operational mode may include a vacation mode. For instance, the predetermined operational mode may be associated with an extended period of time for which the appliance will be idle. Thus, in the instance the input signal is the manual input signal, the user may select a vacation or away mode. As mentioned, the selection may be made via the user interface or through a remote connected device. In some instances, upon receiving the input signal, method 400 may determine that the door of the appliance is in a closed (e.g., latched) position.

At step 404, method 400 may include adjusting the door to a locked state in response to receiving the input signal. For instance, once the predetermined operational mode is entered, initiated, or otherwise implemented, method 400 may lock the door. As mentioned, upon receiving the input signal, method 400 ensures that the door is in the closed position, and thus is able to be locked. A lock (e.g., a child-lock) may be activated such that the door is unable to be opened via external force. The locked state may include deactivating the user interface. For instance, the locked state may prohibit any user from providing certain inputs to the user interface while in the predetermined operational mode. Additionally or alternatively, the door may remain in the locked state for an entire duration of the predetermined operational mode.

At step 406, method 400 may include activating the heating element at a predetermined power level after adjusting the door to the locked state. As mentioned above, the appliance may include a heating element. The heating element may be part of a closed refrigeration circuit (e.g., a condenser), an electric heating element, and air-to-air heating element, or the like. The heating element may be driven at a predetermined level (e.g., power level). For instance, method 400 may monitor a temperature of air flowing through an air circulation system and the tub. The predetermined level may be based on a desired temperature of air through the air circulation system duct. Accordingly, the predetermined level of the heating element may be monitored while the appliance is in the predetermined operational state. In some instances, the predetermine level may be adjusted at one or more points while the appliance is in the predetermined operational state.

As mentioned above, the appliance may include a temperature sensor (e.g., within the air circulation system). The temperature sensor may monitor the temperature of the air flowing through the duct. Accordingly, a desired temperature may be set and maintained while the appliance is in the predetermined operational state. The desired temperature may be sufficient to kill or otherwise eliminate certain mold growth, bacteria growth, yeast growth, or other organic growth, e.g., within the sump of the appliance, throughout the circulation system, or within the tub of the appliance. In some instances, the desired temperature is between about 140° and about 160° Fahrenheit. It should be noted that the ranges presented herein are provided by way of example only and that any suitable desired temperature may be incorporated according to specific embodiments. Accordingly, the heating element may be driven to maintain the temperature of the air at or near the desired temperature (e.g., at the temperature sensor).

At step 408, method 400 may include directing the fan according to a predetermined speed for a predetermined length of time after activating the heating element. As mentioned, the appliance may include a fan (e.g., a blower fan, an air handler, etc.). The fan may be positioned within the air circulation duct to motivate, urge, or otherwise blow air through the air circulation system and tub. The fan may be a multi-speed fan capable of operating (e.g., rotating) at variable speeds. The predetermined speed may be based on the desired temperature. Thus, the fan may be directed at one of a high speed, a medium speed, a low speed, or the like.

The predetermined length of time for which to operate the fan may vary according to specific embodiments. For instance, the predetermined length of time may be based on a plurality of factors, such as amount of time since a most recent washing operation, ambient temperature, previous wash load parameters, heating element power level, or the like. According to at least some embodiments, the predetermined length of time may be between about 10 minutes and about 30 minutes. However, it should be understood that the time lengths presented herein are provided by way of example only and that any suitable length of time may be incorporated.

At step 410, method 400 may include deactivating the heating element after an expiration of the predetermined length of time. Additionally or alternatively, at step 410, method 400 may include directing the fan to an off position. For instance, at the conclusion of the predetermined length of time, the heated air may be stopped from flowing through the air circulation system. For one example, in the instance where the heating system is the closed refrigeration circuit including a compressor a condenser, and an evaporator, the compressor may be stopped or deactivated. According to this embodiment, the fan may continue to operate to provide residual heat to, e.g., the tub, the evaporator, or the like.

In some instances, method 400 may include implementing a predetermined dwell time after deactivating the heating element. For instance, after the expiration of the predetermined length of time and after the heating element and the fan have been deactivated, the appliance may be at least temporarily placed in a dwell or hold state. At this point, no actions may be taken within the appliance. According to some embodiments, the door may be returned to an unlocked state. The predetermined dwell time may be between about 1 day and about 12 days. Additionally or alternatively, the predetermined dwell time may vary according to one or more factors, such as ambient temperature, ambient humidity, time since the most recent washing operation or drying operation, or the like.

Method 400 may include activating the heating element after an expiration of the predetermined dwell time. Additionally or alternatively, in the instance where the door was returned to the unlocked state at the expiration of the predetermined length of time, the door may again be returned to the locked state before activating the heating element. In detail, the locking of the door, the activation of the heating element, and the activation of the fan may collectively be referred to as a cycle (e.g., an ultrafresh cycle). Thus, multiple cycles may be performed over the course of the appliance being in the predetermined operational state (e.g., vacation mode).

As would be understood, method 400 may include directing the fan according to the predetermined speed for the predetermined length of time after activating the heating element. In some instances, the fan is activated at a different speed for a different length of time. Thus, each cycle (e.g., ultrafresh cycle) may be performed according to different parameters (e.g., time length, intensity, temperature, power level, etc.).

Method 400 may include terminating the predetermined operational mode (e.g., vacation mode). For instance, method 400 may include receiving a signal to end the predetermined operational mode and return to a normal operating mode. The signal may be a manual signal input to the user interface, a remote signal from a remote connected device, or the like. At this point, the door may be returned again to the unlocked state.

According to the embodiments described herein, a laundry treatment appliance may selectively operate in a predetermined mode such as a vacation mode, an away mode, a freshening mode, or the like. During the predetermined mode, a heating element and a fan may be activated to circulate heated air at a predetermined minimum temperature through the appliance. For instance, the air may be circulated through a tub including a sump in which stagnant water may be held. Advantageously, the heated air may prevent the growth and proliferation of certain organic materials, such as mold, mildew, yeast, bacteria, and the like.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a laundry treatment appliance, the laundry treatment appliance comprising a door, a tub, a heating element, and a fan, the method comprising:

receiving an input signal to enter a predetermined operational mode, wherein receiving the input signal to enter the predetermined operational mode comprises:

determining that the laundry treatment appliance has been nonoperational for a predetermined idle time length; and initiating the laundry treatment appliance to automatically enter the predetermined operational mode after the appliance has been nonoperational for the predetermined idle time length;

adjusting the door to a locked state in response to receiving the input signal to enter the predetermined operational mode;

activating the heating element at a predetermined power level after adjusting the door to the locked state;

directing the fan according to a predetermined speed for a predetermined length of time after activating the heating element; and deactivating the heating element after an expiration of the predetermined length of time.

2. The method of claim 1, wherein receiving the input signal to enter the predetermined operational mode comprises:

receiving a manual input signal to enter the predetermined operational mode via a user interface of the laundry treatment appliance, the predetermined operational mode comprising a vacation mode.

3. The method of claim 1, wherein the heating element comprises at least one of a closed refrigeration system or an electric heating element.

4. The method of claim 1, wherein the operation further comprises:

maintaining the door in the locked state for an entire duration of the predetermined operational mode.

5. The method of claim 1, further comprising:

implementing a predetermined dwell time after deactivating the heating element after the expiration of the predetermined length of time;

activating the heating element after an expiration of the predetermined dwell time; and directing the fan according to the predetermined speed for the predetermined length of time after activating the heating element.

6. The method of claim 1, wherein the predetermined length of time is between about 10 minutes and about 30 minutes.

7. The method of claim 1, wherein the laundry treatment appliance further comprises:

a circulation duct in fluid communication with the tub, wherein each of the heating element and the fan is positioned within the circulation duct.

8. The method of claim 7, wherein the laundry treatment appliance further comprises:

a temperature sensor positioned within the circulation duct.

9. The method of claim 8, wherein activating the heating element at a predetermined power level comprises:

driving the heating element such that a temperature at the temperature sensor is between 140° and 160° Fahrenheit.

* * * * *